US006561513B1

(12) United States Patent
DeGeorge

(10) Patent No.: US 6,561,513 B1
(45) Date of Patent: May 13, 2003

(54) ROLE AND WAR GAME PLAYING SYSTEM

(76) Inventor: Andrew DeGeorge, 9 Westover Ave., Apt. B-1, Nutley, NJ (US) 07006

( * ) Notice: Subject to any disclaimer, the term of this patent is extended or adjusted under 35 U.S.C. 154(b) by 0 days.

(21) Appl. No.: 09/799,437

(22) Filed: Mar. 5, 2001

Related U.S. Application Data

(63) Continuation-in-part of application No. 09/442,972, filed on Nov. 18, 1999, now Pat. No. 6,209,873.

(51) Int. Cl.[7] ..... A63F 3/02
(52) U.S. Cl. ..... 273/262; 273/265; 283/49
(58) Field of Search ..... 463/9, 47; 273/262, 273/265, 255, 258, 236, 292, 295, 308; 283/48.1, 49

(56) References Cited

U.S. PATENT DOCUMENTS

| | | | | |
|---|---|---|---|---|
| 186,181 A | | 1/1877 | Underwood | |
| 3,048,404 A | | 8/1962 | Tebbs | |
| 3,353,829 A | | 11/1967 | Board | |
| 3,401,936 A | | 9/1968 | Greenberg | |
| 3,565,436 A | | 2/1971 | Opmeer | |
| 3,998,463 A | | 12/1976 | Zumchak | 273/131 BB |
| 4,059,275 A | | 11/1977 | Price | 273/130 D |
| 4,221,389 A | | 9/1980 | Read | 273/262 |
| 4,280,704 A | | 7/1981 | Massimei et al. | 273/258 |
| 4,765,627 A | | 8/1988 | Ross | 273/255 |
| 4,902,017 A | * | 2/1990 | Grammatico | 273/240 |
| 4,982,965 A | | 1/1991 | Dozorsky | 273/262 |
| 5,026,070 A | | 6/1991 | Watt | 273/261 |
| 5,163,688 A | | 11/1992 | Simms | 273/298 |
| 5,171,018 A | | 12/1992 | Zhang | 273/260 |
| 5,251,905 A | | 10/1993 | Bombino | 273/255 |
| 5,388,837 A | | 2/1995 | Hoffman | 273/262 |
| 5,401,031 A | | 3/1995 | Kuna | 273/265 |
| 5,662,332 A | | 9/1997 | Garfield | 273/308 |

OTHER PUBLICATIONS

Robert Markham, *Four Battles of the American Civil War*, from *The Seven Days Battles* pp. 1–16.
Steven Jackson Games, Inc., *An Introduction to Roleplaying*, Gurps Lite Jun. 1999 pp. 1–32.
Jim Lee et al., C*23—*An ARC System Game*, p. 1–11 (1998), distributed by Wizards of the Coast, Inc., http://www.wizards.com/arc_system/C23_Rules.asp.
*Deadlands: The Great Rail Wars* pp. 26–32 (1997), distributed by Pinnacle Entertainment Group, Inc.
*Warzone—Introduction to Table Top Gaming, Mutant Chronicles* pp. 1–16 (1996), distributed by Target Games.

* cited by examiner

*Primary Examiner*—Valencia Martin-Wallace
*Assistant Examiner*—John M Hotaling, II
(74) *Attorney, Agent, or Firm*—Ernest D. Buff & Associates; Ernest D. Buff

(57) ABSTRACT

Combat is resolved and war game play is expanded without the use of dice or the like. Players substantially simultaneously memorialize actions appointed to be taken, and present the actions in a recorded format wherein tactical decisions, not random number s generation, become the driving force. Apparatus used to implement tactical decisions aids in the recording of actions taken, facilitating their subsequent storage and retrieval. The internal logic of hobby war and role playing games is expanded by giving the players of those games the ability to add previously unspecified tactics and actions. The nature of a hobby war game is modified in that the most important element affecting game outcome is a set of decisions made by a player at every engagement.

9 Claims, 9 Drawing Sheets

Fig. 2

DEFENSE STRATEGY →

ATTACK STRATEGY ↓

| | Meet Attack | Stand Firm | Strengthen Left Flank | Strengthen Right Flank | Concentrate Center | Defense in Depth | Disperse Defenders | Tactical Withdrawal |
|---|---|---|---|---|---|---|---|---|
| Charge Forward | 2 | 2 | 1 | 1 | 4 | 2 | 2 | 0 |
| Slow Advance | 2 | 4 | 1 | 1 | 3 | 2 | 2 | 2 |
| Flanking Attack Left | 3 | 2 | 1 | 4 | 2 | 1 | 2 | 2 |
| Flanking Attack Right | 3 | 2 | 4 | 1 | 2 | 1 | 2 | 2 |
| Stationary | 4 | 2 | 2 | 2 | 3 | 4 | 2 | 4 |
| Infiltration | 4 | 3 | 2 | 2 | 1 | 0 | 2 | 4 |
| Encirclement | 3 | 3 | 2 | 2 | 1 | 1 | 3 | 4 |
| Attack from Cover | 2 | 2 | 1 | 1 | 2 | 2 | 2 | 3 |

Fig. 3

GAME SHEET circle one: ATTACKER, DEFENDER

Game: WW II Scenario: hedgerow

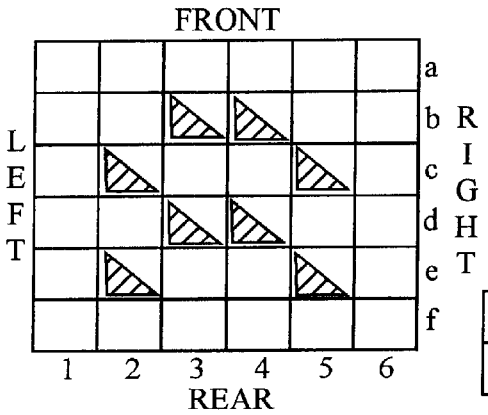

Command Issuing Phase

Attacker: Andrew
2nd panzer

Defender: Ernie
101 Airborne

Tactics:

| Attacker | Defender |
|---|---|
| stationary | defense indepth |

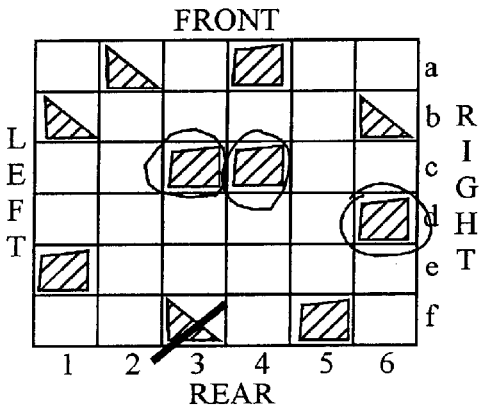

Combat Resolution Phase

Attack Strength 12
Defense Strength 6
Ratio 2:1
Attack Markers 10
Defense Markers 10(4 shields)
Strikes Registered 3
Counter Strikes Registered -1
Summation 2

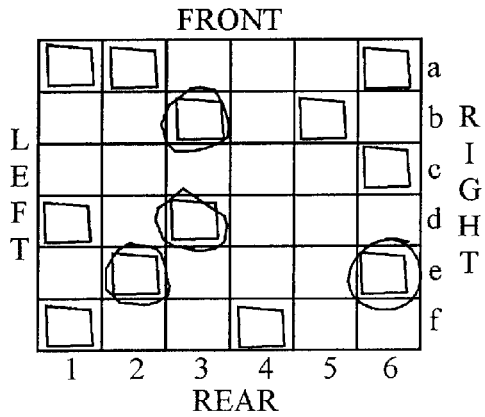

Damage Resolution Phase

Armor / Toughness .4

Markers 12

Scores Registered 4

Engagement Results
1 inflicted
10 causalities

Fig. 4

GAME SHEET circle one: ATTACKER DEFENDER

Game: WW II Scenario: hedgerow

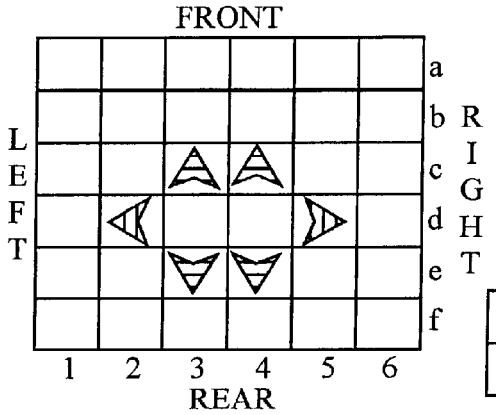

Command Issuing Phase

Attacker: Andrew
2nd panzer

Defender: Ernie
101 Airborne

Tactics:

| Attacker | Defender |
|---|---|
| stationary | defense indepth |

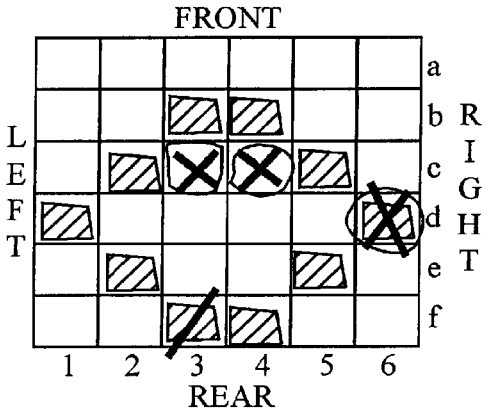

Combat Resolution Phase

Attack Strength 12
Defense Strength 6
Ratio 2:1
Attack Markers 10
Defense Markers 10(4 shields)
Strikes Registered 3
Counter Strikes Registered -1
Summation 2

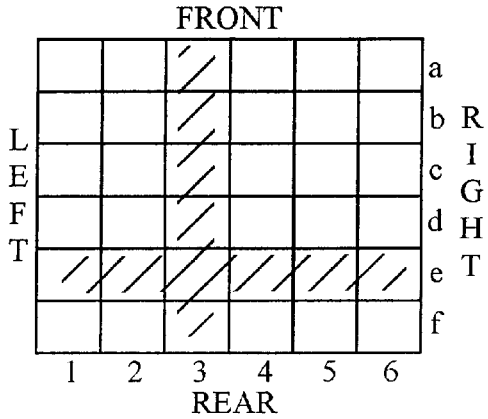

Damage Resolution Phase

Armor / Toughness .4

Markers 12

Scores Registered 4

Engagement Results
1 inflicted
10 causalities

Fig. 5a
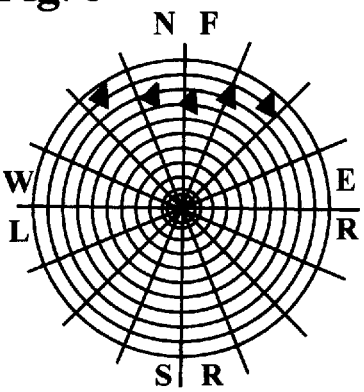
Fig. 5b
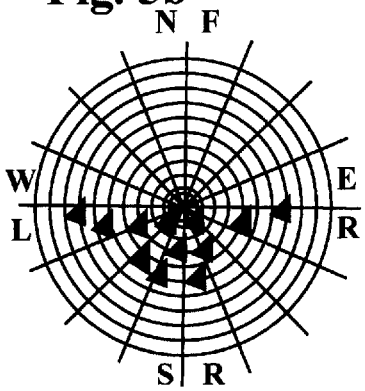
Fig. 5c
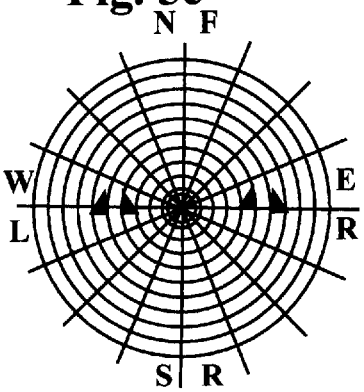
Fig. 5d
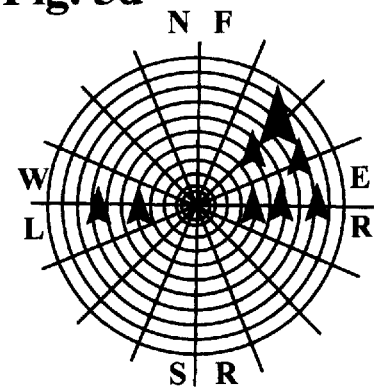
Fig. 5e
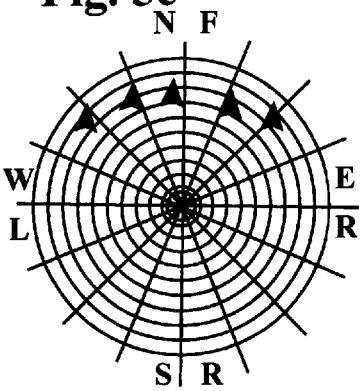
Fig. 5f
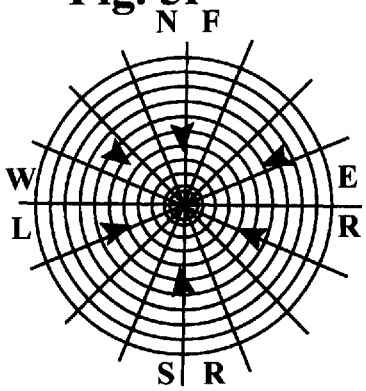
Fig. 5g
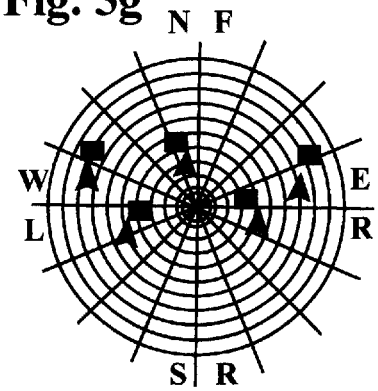
Fig. 5h
Defensive Strategies
Offfensive Strategies
| | | | | |
|---|---|---|---|---|
| 2 | 3 | | 1 | 3 |
| 3 | 0 | | 4 | 2 |
| | | 1 | 3 | 1 |
| 1 | 2 | 0 | 4 | 3 |
| 2 | 3 | 1 | 2 | 4 |

Fig. 6

Turn# 4

Game Sheet

Game Civil War Scenario Inf engag.

N F W E L R S R

General Movement Phase

Units Moving ——

Moving Allowance Percentage of Radius ——

Movement Penalty Per Deg. of Turn ——

Movement Penalty Per Terrain Effect ——

Landmark Legend 1 —— 2 —— 3 ——

Sheet Serial # 01gf83206

Opp# 01sd41220

Command Issueing Phase

Circle One Attack Defend

Attacker's chosen Tactic or Action from the event Matrix: Flanking Attack Left

VS

Defender's chosen Tactic or Action from the event Matrix: Meet Attack

Shields Allocated 3

Units Engaged

Att 3rd Div; 4th R Def 2nd Div; 1st R

Combat Resolution Phase

Front

Left A B C D E F Right 1 2 3 4 5 6

Rear

Attacker's Strength 350

Defender's Strength 150

Ratio 2.3:1

Markers for Attack 10

Markers for Defense 11

Strikers Registered 5

Minus Counter Strikes Registered 1

Sum of Attaker's Strikes 4

Damage Resolution Phase

Front

Left A B C D E F Right 1 2 3 4 5 6

Rear

Armor/ Toughness 0.8

Markers Allocated 8

Scores Registered 4

Engagement Results Defenders Suffers 20 casualties

Fig. 8

Turn# _____

Game Sheet

Game Civil War Scenario Inf engag.

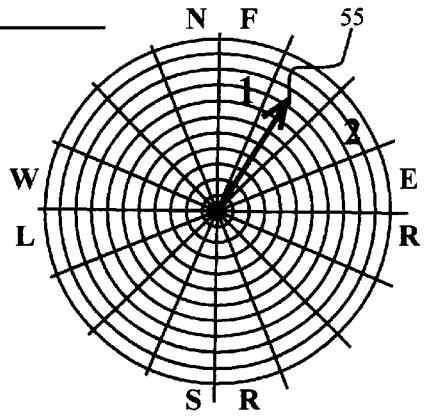

General Movement Phase

Units Moving 7th Reg 3rd Div

2nd Div; 1st R Moving Allowance

Percentage of Radius 10%

Movement Penalty

Per Deg. of Turn _____

Movement Penalty

Per Terrain Effect _____

56

Landmark Legend 1 Farm House

2 Pond 3 _____

57

Command Issueing Phase

Sheet Serial #
01eh57021

Opp# _____

Circle One Attack/ Defend

Attacker's chosen Tactic or Action from the event Matrix

Defender's chosen Tactic or Action from the event Matrix

VS

Shields Allocated _____

Units Engaged

Att _____ Def _____

Combat Resolution Phase

Front

Attacker's Strength _____

| | | | | | | |
|---|---|---|---|---|---|---|
| | | | | | | A |
| | | | | | | B |
| | | | | | | C |
| | | | | | | D |
| | | | | | | E |
| | | | | | | F |

Left Right 1 2 3 4 5 6

Rear

Defender's Strength _____

Ratio _____

Markers for Attack _____

Markers for Defense _____

Strikers Registered _____

Minus Counter Strikes Registered _____

Sum of Attaker's Strikes _____

Damage Resolution Phase

Front

Armor/ Toughness _____

Markers Allocated _____

Scores Registered _____

| | | | | | | |
|---|---|---|---|---|---|---|
| | | | | | | A |
| | | | | | | B |
| | | | | | | C |
| | | | | | | D |
| | | | | | | E |
| | | | | | | F |

Left Right 1 2 3 4 5 6

Rear

Engagement Results _____

ROLE AND WAR GAME PLAYING SYSTEM

CROSS-REFERENCE TO RELATED APPLICATIONS

This is a continuation-in-part of pending application Ser. No. 09/442,972, filed Nov. 18, 1999 now U.S. Pat. No. 6,209,873, entitled "Role And War Game Playing System".

BACKGROUND OF THE INVENTION

1. Field of the Invention

The present invention relates to a war game playing apparatus and method; and more specifically to a method for combat resolution that eliminates the need to generate random numbers, and expands game play by giving players greater control over the actions of the pieces, characters or units that comprise the game.

2. Description of the Prior Art

U.S. Pat. No. 186,181 to Underwood discloses a game apparatus consisting of a board representing military engagement, and miniature soldiers having comparative value, which determines the number of squares that the pieces can move on the board. Any piece has the power to "take" another one of the pieces coming within the range of its moves.

U.S. Pat. No. 3,048,404 to Tebbs discloses a game specifically directed to aeronautical strategy. The game consists of a game board and pieces not limited to direct or diagonal movements. That is to say, turning movements can be used so that the heading of the aircraft indicia on a piece may be changed. Such movements are said to afford a degree of realism in both maneuvering and strategy, which is unobtainable in other games. Playing pieces are octagonal in shape so that aircraft heading indicia may be changed in intervals of 45° relative to the space occupied thereby.

U.S. Pat. No. 3,998,473 to Zumchak discloses a naval combat game consisting of a plurality of squares and tabs defining the open sea in the Eastern and Western hemispheres, coastal waters and respective seaports. There are also provided game pieces representing naval vessels and their particular characteristics, ocean seaports and naval air bases, all of which cooperate to provide a game of skill.

U.S. Pat. No. 4,221,389 to Read discloses a war game apparatus representing a battlefield. The apparatus consists of a plurality of interchangeable weapon pieces, each of which has an identification to represent a range of a particular weapon. The identification of the weapon corresponds to a particular board space in such a location as to be easily hidden from an opponent. This construction and arrangement of the board and pieces is said to represent more closely a true battlefield situation.

U.S. Pat. No. 4,982,965 to Dozorsky discloses a strategic military type board game consisting of a method wherein there is provided a rectangular board game of 126 checkered squares, and a plurality of pieces for each one of the two players, the pieces arranged at opposed sides of the board in such a manner that a "Capital" piece does not move and must be captured by the opposing side in order for the game to be won.

U.S. Pat. No. 5,026,070 to Watt discloses a strategy board game for naval battles consisting of a game board-playing surface. A plurality of playing pieces represent naval vessels having a post extending therefrom. First and second visually distinguishable cylindrical rings indicate vessel power and vessel damage. The rings are stacked on the posts to provide the visual characteristics of the vessels.

U.S. Pat. No. 5,388,837 to Hoffman discloses a game of military strategy that combines elements of skill and chance. A selector dial attached to each playing piece indicates status power of the piece. Game pieces of higher status power have the potential ability to kill, capture or wound a game piece of lesser status power. The selector dial is a movable circular disc divided into six segments corresponding to possible throws of dice. Status power of the playing piece is determined by the selector based on random number generation.

U.S. Pat. No. 4,765,627 to Ross discloses a game of nuclear conflict where two boards comprised of geometric graphs are employed to resolve a conflict. The game also involves the act of guessing where an opponent has located a collection of markers on the game board.

U.S. Pat. No. 5,401,031 to Kuna And Kulesza discloses a strategy attack game like Milton Bradelys "Battleship" that features the interaction of combat aircraft. It involves a plurality of game boards made up of geometric graphs. Each player's board remains hidden from his opponents view. Also disclosed is a procedure wherein a player endeavors to guess" the location of an opponents tokens.

U.S. Pat. No. 4,280,704 to Massimei, et al. discloses a naval warfare game wherein operating surfaces comprise geometric graphs of having rows and columns. Each player controls two graphs or grids. The operating mechanism of the game involves guessing the locations of tokens on the opponent's geometric graph as they are arrayed.

U.S. Pat. No. 3,401,936 to Greenberg discloses a toy baseball game having two game boards in the form of geometric graphs. The game boards are removed from each other and are isolated by screens. Greenberg's patent also discloses the action of locating hidden indicia on an opponent's game board. The indicia appointed for location are distributed by the players in a strategic manner.

U.S. Pat. No. 3,353,829 to Board discloses a game apparatus having shielded game boards, which comprise geometric graphs. The locations for the players' indicia remain hidden until being operated on by an optical viewing device.

U.S. Pat. No. 3,565,436 to Opmeer discloses a game apparatus comprising multiple game boards on which tokens are secretly arranged by the players. The areas of interaction comprise columns and rows on geometric graphs comprised thereof.

U.S. Pat. No. 5,251,905 to Bombino discloses a method of playing a war game using a game board having a plurality of geographic regions that tokens act upon. The geographic regions are divided into squares that form rows and columns.

The playing procedure for each of these games requires the players to take turns being the aggressor. When one player is taking aggressive action, the opposing player normally takes little or no action, in accordance with the game rules. None of the conventional hobby war games permits both the attacking and defending players to perform turns substantially simultaneously. Nor do conventional hobby war games provide procedures for combat resolution and expanding war game play without use of dice or other random number generators. In those games wherein the location of game pieces or markers on an opponents game board or surface is guessed by the players, the "guessing action" proceeds in an incremental fashion where one guess is made about one portion of the board at a time.

SUMMARY OF THE INVENTION

The present invention virtually eliminates the need to generate random numbers. Game play is expanded by providing hobby war game players greater control over the actions of the pieces, characters or units that comprise the game. The game provides a means for players to substantially simultaneously memorialize actions appointed to be taken, and present the actions in a recorded format wherein tactical decisions, not random number generation, become the driving force. Apparatus used to implement tactical decisions aids in the recording of actions taken, facilitating their subsequent storage and retrieval. In a preferred embodiment, there is provided, a means for expanding the internal logic of hobby war and role playing games by giving the players of those games the ability to add previously unspecified tactics and actions. The invention changes the nature of a hobby war game in that the most important element affecting game outcome is a set of decisions made by a player at every engagement.

In one aspect of the invention, there is provided a method for defining a strategy, tactic or action of a game piece, character or unit. The strategy is defined by an arrangement of multiple graphical elements or markers. Normally, the markers specific placement on a geometric graph is such as to suggest the strategy, tactic or action that is being taken in the source game. The graphical elements provide a player with options for creating strategies, tactics or actions to address a plurality of situations or scenarios.

In practice, the method of the invention is accomplished by comparing the interactions of two players of a game. These interactions comprise elements of strategy, tactics or actions represented by an array. Each defined element of strategy, tactic or action is compared against all elements of an opponent's strategy, tactics or actions to produce a value that indicates how the combat resolution of the game is proceeding. Preferably, the interaction is modified by application of a special marker operative during a decision based combat resolution phase of the game in accordance with a defined set of rules. One specific interaction involves the simultaneous movement of figures, characters or units. The interactions are performed and memorialized on conflict resolution sheets.

Generally stated, the apparatus of the invention includes a game board comprising a geometric graph. This geometric graph is used to define the space around a game piece, character or unit in relation to the game piece, character or unit. Information about the formation, attitude or motion of the game piece is provided by the markers or graphic elements in accordance with a defined set of rules.

The present invention is advantageous for its lack of dependence upon the conventional use of dice or other random number generators in order to drive game play and force the players to make tactical decisions. Many important variables and scenarios occur during actual combat. Strategic and tactical decisions must be made in order to accommodate these situations and the inevitable outcome of decisions made and relied upon. In effect, there are a myriad of possibilities which the attacker or defender must prepare for. Each player, when assuming the position as either an attacker or defender, must react to the combat theater he or she finds himself thrust into. The player must also rely upon lessons learned from previous moves in order to determine the best course of action to attack or defend a position. The combat resolution mechanism of the present invention accurately simulates mechanisms for addressing and resolving real combat scenarios. Game play is highly satisfying and much more proximate to actual combat resolution.

In another aspect of the invention, disposable sheets of paper, vellum or plastic are used in place of a game board and detachable markers. Preferably, a plurality of conflict resolution game sheets are adapted to be torn away from a sheet tablet. Use of a tablet is advantageous because it provides for easy storage and organization for the sheets and creates a rigid surface on which to write. Moreover, with use of disposable conflict resolution sheets, the actions performed by each player occur substantially simultaneously, as the players draw the indicia on their sheets. These substantially simultaneous actions are affected without random number generation.

Conflict resolution is further facilitated through use of conflict resolution sheets that are semi or fully transparent. The transparent characteristic of the sheets permits a first player's game sheet to be laid over a second player's sheet, so that the marked and unmarked areas of the superimposed conflict resolution sheets are readily ascertained. When a player holds a plurality of conflict resolution sheets in an overlaid, superimposed position, the intersections of the conflict and resolution phases are readily apparent. Additional symbols or annotations are drawn on the top sheet, causing the final results of the conflict resolution process to be tallied quickly in a highly accurate manner. The procedure is thereafter completed by redistributing the annotated sheet to the second player for confirmation of results noted by the player, and annotation of the second player's sheet Tracking of information recorded on the conflict resolution sheets is aided by providing each sheet with certain identifiers, such as a unique, sequential, serial number. Use of unique, sequential, serial numbers facilitates identification of the sheets and makes them easy to trace. A blank space located beneath the serial number is used to record the serial number of the opponent's conflict resolution sheet. Means for recording the turn for which a game sheet is being used further assists with identification and tracing of the sheets. These features are especially useful when sheets of one player are distinguished from another during tournament play involving numerous participants. The record provided by the sheet identifiers discussed hereinabove can be used by tournament judges evaluating player performance.

In yet another aspect of the invention, a polar coordinate graph is placed within the General Movement Phase section of each conflict resolution sheet. The General Movement Phase comprises a procedure that enables two opposing players to move their game pieces in the game space at substantially the same time. A player marks the polar coordinate graph to depict the direction and distance of movement for a specific figure, character or unit. The center of the graph defines the current position of the figure, character or unit. A vector pointing towards the top of the sheet defines the northern direction, or the direction that a specific figure, character or unit is then facing. In certain game formats, the directions of the north, south, east and west coordinates are critical. The right side of the graph defines the easterly direction, or the right side of the figure, character, or unit. A line or vector is drawn away from the center of the graph. The length of this line is related to a movement allowance, which is provided by the source game manufacturer. A ratio between the percentage of the movement allowance and the percentage of the total radius covered by the vector is then established by (i) the players themselves, (ii) the manufacturer of the source game, or (iii) the game master. If, for example, the polar coordinate graph contains ten concentric circles, then each circle that the vector passes through could represent 10% of the movement allowance allocated for a game piece. Even though a drawn vector describes a straight line, the actual path of a game piece can be entirely different. A direct path may not be available due to the presence of an impassible obstacle placed directly in the vector's path. In accordance with the rules of a source game, the game piece maybe required to take a circuitous rout to reach the intended destination. In certain cases, a game piece might expend all of its movement allowance without reaching the location in the game space the vector is pointing to. Inasmuch as the location has been memorialized on the graph, the players are required to move their game pieces as close to the location as possible. With this rule in effect, both players can move the game pieces at substantially the same time without becoming concerned about their opponent changing his mind during the physical moving process. It follows that an additional element of uncertainty is added which is independent of and requires no reliance on random number generation to provide it. The procedure is clarified by placing a legend on a sheet that contains numbers with blank spaces next to them. Providing blank spaces enables the players to set forth a brief written description of the specific terrain features extant in the game space and within the vicinity of movement of a game piece. Once these numbers are defined, the player writes them on the polar coordinate graph. Vectors are then drawn relative to the memorialized landmark numbers to aid in specifying the exact location to which the figure, character or unit will move.

In still another aspect of the invention, the conflict resolution sheet and the procedures for creating markings and images thereon can be generated and implemented by an electronic device. Typically, the device comprises: an LCD or other light emitting display; (ii) an alphanumeric key pad; (iii) game indicia manipulation means for generating and moving images representing the indicia on graphics contained by the device: (iv) transmitting means for effecting the transmission by radio, microwaves or through a wire connection; (v) RAM memory means for storing game rules and procedures; and (vi) software means, for down loading game rules into RAM memory using a memory card or direct computer connection. One device that is representative has been produced and sold by the Cybico Company as a wireless entrainment system. This device is capable of creating electronic images depicting game indicia on an LCD screen and sending text messages. It also comprises means for establishing a connection with a computer. By connecting a plurality of these devices together using the same peripheral, combat resolution in hobby war games can be achieved in an accurate, reliable and efficient manner. Devices are preferably associated with a computer, which performs matching and storing functions for pertinent information required during game play. Graphics used during each stage of the conflict resolution appear on the LCD screen, and the players utilize appropriate keys to create the images otherwise produced by marking transparent or semi transparent game sheets.

BRIEF DESCRIPTION OF THE DRAWINGS

The invention will be more fully understood and further advantages will become apparent when reference is had to the following detailed description and the accompanying drawings, in which:

FIG. 2 shows an event matrix;

FIG. 3 depicts a game sheet completed by a defender;

FIG. 4 depicts a game sheet completed by an attacker.

FIG. 5*a* illustrates a polar coordinate graph disposed on a conflict resolution sheet having indicia arranged representing a meet attack defensive strategy;

FIG. 5*b* illustrates a polar coordinate graph disposed on a conflict resolution sheet having arranged thereon indicia representing a concentrate center defensive strategy;

FIG. 5*c* illustrates a polar coordinate graph disposed on a conflict resolution sheet having arranged thereon indicia representing a stand firm defensive strategy;

FIG. 5*d* illustrates a polar coordinate graph disposed on a conflict resolution sheet having arranged thereon indicia representing a flanking attack right offensive strategy;

FIG. 5*e* illustrates a polar coordinate graph disposed on a conflict resolution sheet having arranged thereon indicia representing a charge forward offensive strategy;

FIG. 5*f* illustrates a polar coordinate graph disposed on a conflict resolution sheet having arranged thereon indicia representing an encirclement offensive strategy;

FIG. 5*g* illustrates a polar coordinate graph disposed on a conflict resolution sheet having arranged thereon indicia representing an attack from cover offensive strategy;

FIG. 5*h* illustrates the manner by which an event matrix is employed to determine the number of shield indicia appointed for allocation;

FIG. 6 illustrates a conflict resolution sheet filled out by the defender and having indicia drawn thereon to operate Command Issuing, Combat Resolution, and Damage Resolution Phases;

FIG. 8 illustrates a conflict resolution sheet having a vector drawn on a Coordinate Polar Graph to thereby represent the action taken in a General Movement Phase.

DESCRIPTION OF THE PREFERRED EMBODIMENTS

Figure 1:
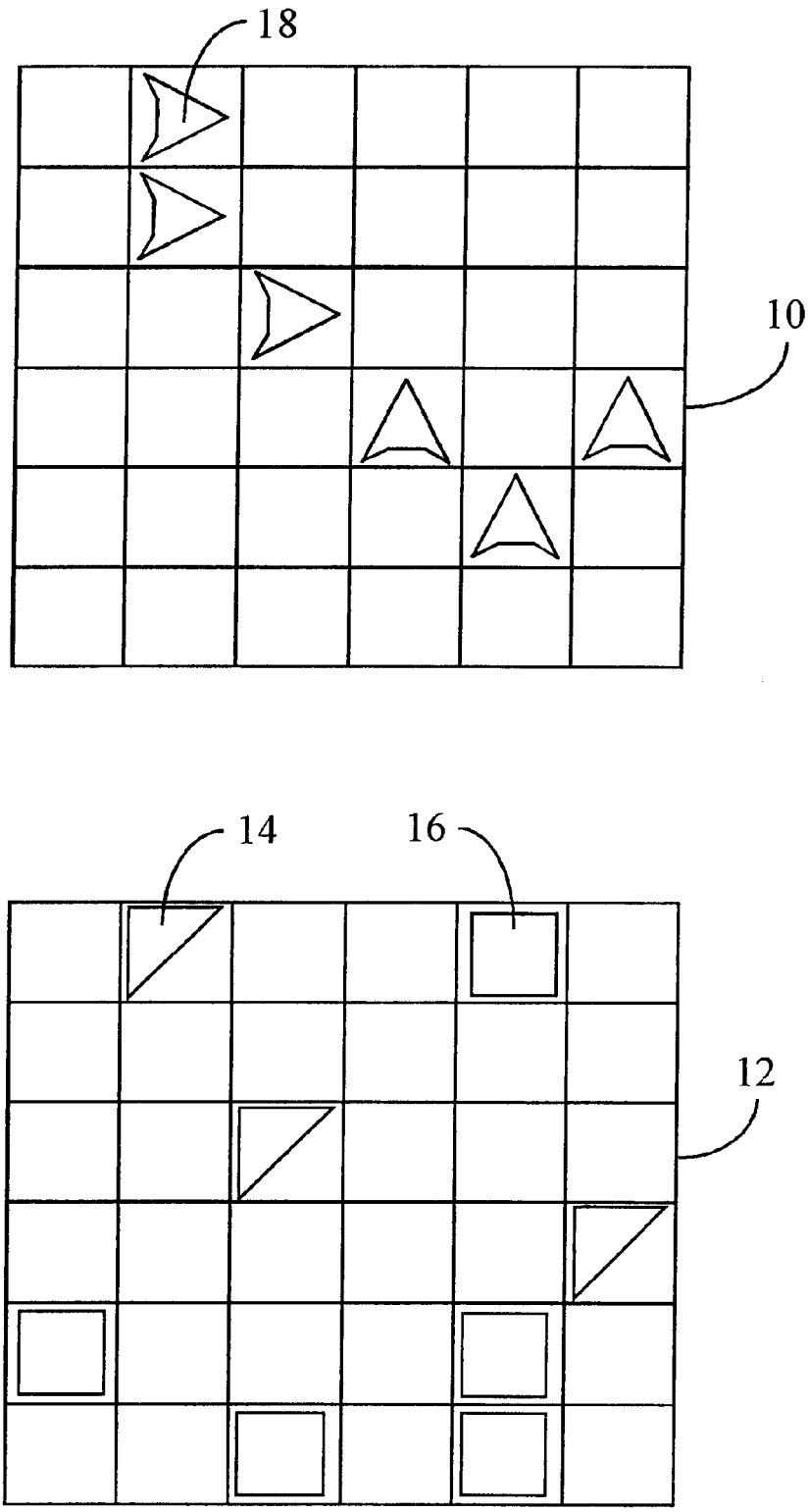
FIG. 1 depicts an attack conflict resolution board and a defense conflict resolution board with markers.

The present invention provides a method and apparatus for resolving combat and expanding war game play. Resolution of combat is accomplished without the use of dice or the like. Tactical decisions, not random number generation, become the driving force. In practice, during a strategy game conflicting armies of the players are disposed on a game board. An attacking player may move game pieces in conflict with a defending player. Traditionally, dice or random number generation has been used to determine the outcome of the conflict.

The present invention provides an apparatus and method for resolving individual conflicts during a game that is not based on chance generation of random numbers. In order to provide a more complete understanding of the invention, definitions of key terms used throughout the specification are set forth below.

As used herein, the term "game piece" means a figurine or other physical representation of a real object, such as a warrior, monster, war engine or weapons platform (i.e. a tank, artillery piece, vessel or aircraft) adapted to become a place marker on a battlescape, field of play or game surface.

The term "character", as used herein, means a non-physical representation of an actor in a free-form, role playing environment.

As used herein, the term "unit" means a platoon, company, brigade, division, fleet, air-wing, squadron, and the like that is represented by a counter on a game surface, board or map.

The term "sheet tablet", as used herein, means a plurality of game sheets normally held together at one side of the sheet, preferably the top edge, to form a collection of game sheets that permits removal of one or more sheets therefrom during game play and creates a rigid surface upon which to write.

The term "conflict resolution sheets" or "game sheets", as herein used means semi or fully transparent sheets composed of paper, vellum or plastic, that are printed with text and graphics to facilitate substantially simultaneous resolution of intersecting marks representing movement, combat and damage related to game pieces deployed by an attacker and a defender during hobby war game play.

The term "drawn Marks", "graphical elements" or "indicia", as used herein, means symbols inscribed on a game sheet with a writing implement in accordance with a defined procedure, and which replaces the traditional positioning of individual markers on a game board.

The term "fill out" means the act of producing drawn marks on a conflict resolution sheet.

The term "landmarks" means readily identifiable features of a game space or battlscape, including houses, bridges, hilltops, rock outcroppings, lakes, rivers and the like.

The term "annotations", as used herein, means the symbols that are comprised of but not limited to circles, slashes, X's that are drawn on the game sheet to aid with the counting of points of intersection (typically designating strikes and scores).

The term "source game" as herein used means any pre-existing game produced professionally or by the players themselves to which the conflict resolution means of the present invention is applicable. Examples of source games constitute "Warhammer" by Games Workshop and "Heavy Gear" by Dream Pod 9.

The term "geometric graph" as used herein, means the fixed diagrams printed on a game board or a conflict resolution sheet.

The term "geometric array" or "array" as used herein means the physical arrangement of markers or the arrangement of drawn marks on a conflict resolution sheet.

Briefly stated, there is provided in accordance with the invention, a method for defining a strategy, tactic or action of a game piece, character or unit. The strategy is defined by an arrangement of multiple graphical elements or markers. The graphical elements provide a player with options for creating strategies, tactics or actions to address a plurality of situations or scenarios.

In one embodiment, the method of the invention is accomplished by comparing the interactions of two players of a game. These interactions comprise elements of strategy, tactics or actions represented by an array. Each defined element of strategy, tactic or action is compared against all elements of an opponent's strategy, tactics or actions to produce a value that indicates how the combat resolution of the game is proceeding. Preferably, the interaction is modified by application of a special marker operative during a decision based combat resolution phase of the game in accordance with a defined set of rules.

Generally, the apparatus of the invention includes a game board comprising a geometric graph. This geometric graph is used to define the space around a game piece, character or unit in relation to the game piece, character or unit. Information about the formation, attitude or motion of the game piece is provided by the markers or graphic elements in accordance with a defined set of rules.

It will be understood by those skilled in the art that the defined set of game rules can vary depending upon the game being played. In such instances, it is important that the quantum of information provided by the game rule set convey sufficient information to enable a player to develop an appropriate appreciation of the formation, attitude or motion of each game piece based on the arrangement of markers or graphical elements.

There are extant many different types of markers, as well as a large number of different orientations, which the symbols can take. Accordingly, there is possible a large number of possible arrangements of the markers. The numerous marker arrangements permit each player to graphically represent a strategy. Such representations can indicate a course of action as simple as advance, or retreat; or they can define a much more detailed action. Not infrequently, they convey more detail than conventional games allow. The detail can be significantly greater because the graphics express much more information than text. They also provide the option of creating representations that are specific to the game or scenario.

Preferably, the apparatus for resolving a conflict in a strategy game comprises: (a) a conflict resolution board, the board comprising a geometric graph; and (b) a plurality of markers, each of which represent a military unit. The markers are provided with graphics indicating the formation, attitude of motion of the unit in accordance with a defined set of rules; so that the outcome of the conflict is dependent upon the formation, attitude or motion of the military unit.

In a specific embodiment, conflicts are resolved during play of the strategy game by a method comprising the following steps: (a) the attacker secretly arranges markers on a first conflict resolution board; (b) the defender secretly arranges markers on a second conflict resolution board; (c) the players then identify regions of conflict on the first and second conflict resolution boards (which regions can be readily ascertained by locating areas defined by intersecting coordinates on the boards). An attacker's strategy is to anticipate regions where the defender's markers will be placed. The defender's strategy involves avoiding placement of markers in regions where markers of the attacker will be placed.

Referring to FIG. 1 of the drawings, the apparatus generally comprises first conflict resolution board 10 and second conflict resolution board 12, each having 6 columns and 6 rows. Appointed for placement on board 12 are the following: (i) a plurality of shield markers 14; (ii) a plurality of body markers 16; and (iii) a plurality of pincer markers 18. Items appointed for placement on board 12 are not limited to items (i) to (iii), but comprise additional items, such as blank (or user defined) markers and the like. The apparatus further includes a attack strategy list, shown in Table I; a defense strategy list, also shown in Table I; an event matrix, shown in FIG. 2; a fire/melee chart II; and a damage resolution chart, shown in Table III. The values in these charts are not limited to those listed. Use of different values would change the relative effect of the results; but would not change the scope thereof. Accordingly, such modifications are intended to fall within the scope of the invention. The first conflict resolution board is used by the attacker while the second conflict resolution board is used by the defender; this allocation of the boards is applicable to each conflict involved in the game.

In the embodiment shown, the columns of the strategy board are defined by the numbers 1 through 6, and the rows are defined by the letters "A" through "F." The horizontal side of the apparatus closest to the player is known as the "Rear"; the side furthest from the player is know as the "Front". Vertically running sides are marked appropriately "Left" and "Right".

Preferably, markers are square and made of cardboard. However, it will be appreciated that they can have any suitable material and shape. In an alternative embodiment, the markers are plastic disks. Preferably, the "body" markers are imprinted with a "square" symbol. The "shield" markers are imprinted with a "triangle" symbol. In this embodiment, the "pincer" markers are imprinted with an "arrowhead" symbol. Optionally, a further type of marker is blank; its function is defined prospectively by the players.

TABLE I

Strategy Lists

| Attack Strategy | Defense Strategy |
|---|---|
| Charge Forward | Meet Attack |
| Slow Advance | Stand Firm |
| Flanking Attack Left; Right | Strengthen Left; Right Flank |
| Concentrate on Center | Concentrate Center |
| Infiltration | Defense in Depth |
| Encirclement | Disperse Defenders |
| Attack from Cover | Tactical Withdrawal |

TABLE II

Fire/Melee Chart

MARKER ALLOCATION

| Ratio | Offense | Defense |
|---|---|---|
| 5.00:1+ | 15 | 15 |
| 4.00:1 | 14 | 14 |
| 3.00:1 | 12 | 14 |
| 2.50:1 | 12 | 12 |
| 2.25:1 | 10 | 11 |
| 2:1 | 10 | 10 |
| 1.75:1 | 10 | 8 |
| 1.50:1 | 9 | 8 |
| 1.00:1 | 9 | 7 |
| 0.75:1 | 8 | 7 |
| 0.50:1 | 8 | 6 |

TABLE III

Damage Resolution Chart

| Attacker | Defender | |
|---|---|---|
| | Relative Value | # of Markers |
| | 1.0 | 6 |
| | 0.9 | 7 |
| | 0.8 | 8 |
| | 0.7 | 9 |
| # of Strikes Recorded* | 0.6 | 10 |
| | 0.5 | 11 |
| | 0.4 | 12 |
| * (# is derived from | 0.3 | 13 |
| Combat Resolution Phase) | 0.2 | 14 |
| | 0.1 | 15 |

Resolution of the results of a conflict between an attacker and a defender in the strategy game is accomplished by a method comprising the following steps. The relative strength ratio of the attacking force to the defending force is calculated using the predetermined rules of said game. The internal logic of the method requires this because understanding how an attacker's strength matches the strength of his opponent is an essential first step in choosing a strategy tactic or action. An attacker secretly selects an attack strategy from a predetermined list of attack strategies. A defender secretly selects a defensive strategy from a predetermined list of defense strategies. The attacker and the defender memorialize their selected strategies, which are thereafter revealed to one another. A determination is made regarding the intersection of the attack strategy and the defense strategy based on a predetermined event matrix. From the intersection there is selected the number of shields to be used by the defender that modify the combat resolution phase. A selection is also made as to marker allocation from a predetermined fire/melee chart, using the relative strength ratio. The attacker secretly arranges the attack marker allocation on a attack strategy board. At substantially the same time, the defender secretly arranges the defense marker allocation on a defender's conflict resolution board. The attacker and the defender reveal the board arrangements of their markers to one another. A determination is then made concerning the number of strikes, as well as the number of damage resolution markers from a predetermined damage resolution chart. The number of strikes determines the number of rows and columns that the attacker will be permitted to designate during the damage resolution phase. The number of damage resolution markers allocated to the defender is determined by the ratio of defensive attributes for the unit engaged versus the highest value of defensive attributes of any unit in the game. Thereafter, a defender secretly arranges the damage resolution markers on the defense conflict resolution board. The attacker selects columns and rows on the attacker's conflict resolution board that will operate to select the same columns and rows on the defender's conflict resolution board. A determination is then made concerning the number of damage resolution markers on the defender's conflict resolution board residing in the same column the attacker has selected on his conflict resolution board. The procedure is thereafter repeated by the players; but this time with relation to rows not columns. Percent loss is then calculated from a predetermined formula relating the number of damage resolution markers on the selected columns and rows. The defender is assessed with the percent loss for the conflict.

The game is played by moving characters or units around a battlescape or imaginary environment. During deployment, the units or characters move into an approximate position. A unit is explicitly positioned through use of the game board and markers, which define its exact formation. This is the Command Issuing Phase. Once a formation or tactic has been chosen, the combat resolution phase commences. This phase is a one-turn, sub-game that allows the players to choose high or low risk gambits. Gambits herein refer to the logic that a player uses to specifically arrange the markers on the game board. Even though there is not present a random number generator, uncertainty is provided by the fact that both players are acting simultaneously throughout the sub-game. In addition, there exist an enormous number of gambits and specific arrangements among which the players may choose.

The method for resolving combat is essentially the same for each stage of the game. The difference is experienced after the combat resolution phase has been completed. The Combat Resolution Phase is a simple one-stage sub-game, the objective of which is accomplished by the attacking player if he identifies the correct location of markers arranged by the defending player on his game board. An attacker does this by arranging markers on his game board. The overriding factor in this sub-game is the number of markers each player uses. Generally, the more markers the attacking player has, the better becomes the chance that he will guess correctly. Conversely, increasing the number of markers a defender must arrange on his board lessens his chances. It thus follows that attackers with high combat ratings tend to use more markers than less powerful units. Likewise, strong defenders generally use less markers than weaker defenders.

The first step is to translate the combat ratings or strengths of the characters or units in the engagement into a proportion that will be related to a number of markers that each player will use. Therefore, a ratio is calculated for each engagement. All the pertinent factors are combined for both the attacking and defending players. The combined value of the attacking player is then divided by the combined value of the defending player. This works for both single and massed combat situations. The only difference is that in massed combat all the values of the units are combined together prior to calculating the ratio. This means that the result of the combat will be shared by multiple units. It is important to clarify what constitutes single and massed combat. Single combat involves only two entities such as when two man 'o war vessels square off at sea. However, if one side had two man'o war vessels, a massed combat situation would be presented with respect to the two vessels, while the lone vessel would, of necessity, be involved in a single combat situation if it were attacking. These calculations produce a ratio such as 3.00:1 or 1.75:1, for example. Naturally, the ratio should be a number greater than one if there is to be any chance of success. The marker allocations are found on the Fire/Melee chart. These are for the 3.00:1 ratio, 12 markers for attacking and 14 markers for defending. The 1.75:1 ratio is 10 markers for the attacker and 8 markers for the defender. It should be clear that the more markers the attacker has the more likely he or she will be successful. Conversely, the a defender having fewer markers is more likely to survive the combat.

In games where the combat rating is given as a value that must be met when rolling dice or using some other random number generator, another step must be included. These systems typically involve a probability of success. For instance, the rules may state that an attack is deemed successful if the player rolls an 8 or less on a 20 sided die. This equates to a probability of 0.4, which now becomes the relative offensive strength of the unit or character. If the situation was reversed, so that the player's attack would be successful as long as an 8 or less was not rolled, the probability would become 0.6 (12/20). Then the manner described above is applied to these probabilities.

The resolution sub-game has only one turn (or operation). The objective of this operation is clear—the attacking player attempts to guess where the defending player will distribute a given number of markers (see Fire/Melee Charts) on his game Board. The attacking player accomplishes this objective in one of two ways. First, by blocking out a contiguous area on the attacking players board. Contiguous area, as defined herein, means a collection of body markers placed in such a way that each marker makes contact with the comer or the side of at least two other markers. If the defending player has any markers in the corresponding area they are counted as "strikes". A second method involves use by the attacking player of his arrow (pincer) markers to cordon off a corner of the game board. Because this is a much more efficient way of encompassing an area, the attacking player is permitted to use no more than half the markers granted from either chart. The pincer markers will be pointed towards one corner only. Additionally, the attacking player is prohibited from placing these markers in the 4 corner squares of the game board. This prevents the player from cordoning off more than half the board. The defending markers that are in the partitioned area as well as in the squares occupied by pincers, are recorded as strikes. The level of risk attributed to a gambit is determined by these actions. Clearly, if a defending player were to place all his markers in one comer of the board his risk of suffering a severe defeat increases. The risk is high because the attacking player could choose to cordon off this comer. Of course, if the attacking player chooses a different comer, the results would be exactly the opposite. This is a good example of a high-risk (or reward) gambit. A low risk gambit would involve evenly distributing markers across the game board for example. This gambit would significantly increase the chance that a few strikes would be registered, though it would also make it virtually impossible for the defender to receive an excess of strikes.

The more strikes an attacking player registers, the more successful becomes his or her attack. This is true because of what will happen in the damage resolution phase. However, the defender has been granted a number of counter strikes depending on how the two players tactics match up on the event matrix. These counter strikes, as their name suggests, are used to cancel strikes made by the attacker. In order to do this, the counterstrike marker, represented by a shield symbol, must reside in the same position as one of the attacker's markers. Those counter strike shield markers that are simply within the space blocked out by the attacker's markers are simply not counted as strikes. If the defender has more counter strikes registered than the attacker has strikes, then the defender has won the engagement completely and the attacking player will be the one to receive casualties in the Damage Resolution Phase.

Strikes accumulated in the combat resolution phase are next used to determine the condition the defender is left in. The defender distributes a given number of body symbols throughout his board, while the attacker chooses rows and columns that equal the number of strikes he has accumulated (5 strikes=2 rows and 3 columns or vice a versa). The attacker chooses the row or column by either filling that row or column with markers or drawing indicia therein. The percentage of markers that are within the corresponding rows or columns chosen by the attacking player becomes the "quantum" of damage or casualties the defender has suffered.

These values are herein referred to as scores. Players should feel free however to make adjustments to scores as they see fit. For instance, players may want to make the number of initial scores needed to generate any damage dependent on the type of character or unit that is engaged.

The number of markers used by the defender is determined by converting the characters defensive rating such as durability, armor, fighting Elan or all factors combined into a percentage of these attributes relative to the highest values of these attributes involved in the specific game. In other words, if a character were half as durable as the most durable character in the game he would be granted twice as many markers to distribute as the most durable character. When units are made up of two or more different strengthened sub-units the attributes are averaged after being weighted.

In another embodiment, game sheets are used instead of a board, and markers are drawn on the game sheets instead of placing pre-made markers on the board. Advantageously, with this embodiment, the game sheets can be readily reproduced and kept for permanent record. FIG. 3 shows a game sheet that has been completed by the defender in an engagement. In FIG. 4, there is shown, a game sheet that has been completed by the attacker in an engagement. As illustrated by FIGS. 3 and 4, game sheets are divided into three parts: Command issuing Phase; Combat Resolution Phase; and Damage Resolution Phase.

Referring to FIGS. 5*a* through 5*g* there are shown polar coordinate graphs on which are placed graphical representations of strategies, tactics and actions. Use of the polar coordinate graphs permits players to convey information concerning deployment of game pieces in an efficient manner. Pincer indicia and shield indicia are readily drawn on the polar coordinate graphs in accordance with a prescribed set of rules. FIGS. 5*a* through 5*c* depict marker arrangements connoting defensive strategies, whereas the marker arrangements of FIGS. 5*d* through 5*g* connote attack strategies.

More specifically, in FIG. 5*a* there is shown an arrangement of shield indicia that conveys a "meet attack" strategy. FIG. 5*b* illustrates an arrangement of shield indicia that conveys a "concentrate center" defensive strategy. The arrangement of shield indicia shown by FIG. 5*c* conveys a "stand Firm" defensive strategy. FIG. 5*d* contains an arrangement of pincer indicia representing a "flanking attack right" offensive strategy. FIG. 5*d* also demonstrates how the graphical representation can be modified to convey additional information. For example, in FIG. 5*d*, one pincer indicia has deliberately been drawn larger then the others. This size differential represents the relative position of the command figure to the rest of the unit. The instructions for drawing the representative indicia, and for physically deploying the game pieces in the game space, are typically provided by a prescribed set of rules that accompany the source game. FIG. 5*e* depicts an arrangement of pincer indicia that conveys a "charge forward" offensive strategy. FIG. 5*f* contains an arrangement of pincer indicia that shows an "encirclement" offensive strategy. FIG. 5*g* contains both body and pincer indicia that conveys an "attack from cover" offensive strategy. In an "attack from cover" offensive, the pincer indicia are placed substantially behind the body indicia, which deployment suggests a figure crouching behind a protective feature of the game space. It will be evident from this deployment that drawn body indicia can represent specific features of the game space.

Referring to FIG. 5*h*, there is shown the manner by which the eye travels on the event matrix to determine the number of shield indicia appointed for allocation. The eye will move down the column of the defensive strategy selected until it crosses the row of the selected offensive strategy, thereby identifying the square that contains the number of shield indicia available for allocation.

Figure 7:
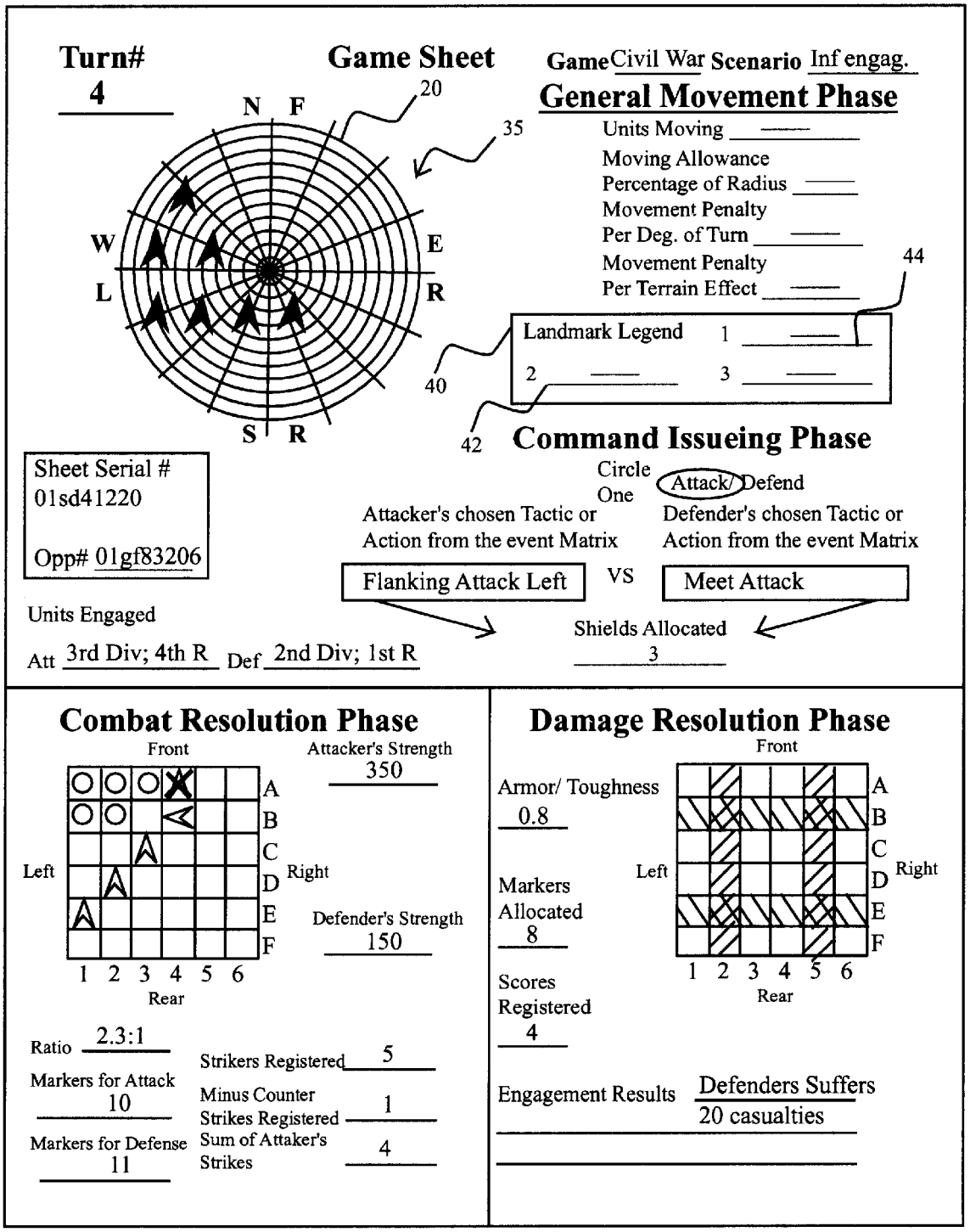
FIG. 7 illustrates a conflict resolution sheet filled out by the attacker, and having indicia drawn thereon for operation of Command Issuing, Combat Resolution, and Damage Resolution Phases.

Referring to FIGS. 6 through 8, there is shown an improved conflict resolution sheet. Strategies selected by the attacker and defender may be memorialized thereon in the manner described hereinabove with reference to FIGS. 3 and 4. In addition, the conflict resolution sheets of FIGS. 6 through 8 include a General Movement Phase. Prior to combat there usually is at least one turn where the players are only involved in moving their figures, characters or units in the game space. At this time the General Movement Phase can be conducted. The General Movement Phase is the method of two or more players moving their game pieces simultaneously by memorializing the direction and distance on polar coordinate graphs, as shown by FIG. 8. A vector drawn on a polar coordinate graph always starts at the center of the graph, because that location is understood to be the current position wherein the game piece is residing. The end of each vector, typically comprising an arrowhead, will point a direction relative to the 4 directions demarked by the letters at the corners of the graph. Those 4 directions are defined as front, rear; right and left using the letters on the left or bottom side of the axis. Alternatively, the letters to the right or bottom of the axis define north, south, east, and west directions. The General Movement Phase is implemented by the players simultaneously drawing a vector 55 in the polar coordinate graph in the direction he intends a figure, character or unit to move. The number of concentric circles on the polar coordinate graph the vector passes through determines the distance for the direction in which the figure character or unit is intended to move. For example, each concentric circle the vector passes through could be appointed to represent 10% of the movement allowance provided by the source game. Even though a drawn vector describes a straight line, the actual path of a game piece can be entirely different. A direct path may not be available due to the presence of an impassible obstacle placed directly in the vector's path. In accordance with the rules of a source game, the game piece maybe required to take a circuitous route to reach the intended destination. In certain cases, a game piece might expend all of its movement allowance without reaching the location in the game space the vector is pointing to. Inasmuch as the location has been memorialized on the graph, the players are required to move their game pieces as close to the location as possible. With this rule in effect, both players can move the game pieces at substantially the same time without becoming concerned about an opponent changing his mind during the physical moving process. An additional element of uncertainty is thereby added without relying on random number generation to provide it. The procedure is clarified by placing a legend 40 on the sheet that contains landmark numbers 42 with blank spaces 44 next to them. The blank spaces 44 enable the players to make brief written descriptions 56,57 of specific terrain features extant in the game space within the vicinity of movement for the game pieces. Once the landmark numbers 42 are defined, a player can write them on the polar coordinate graph 30. Vectors can then be drawn relative to the memorialized landmark numbers 42 to help specify exactly the location to which a figure, character or unit is going to move.

Figure 9:
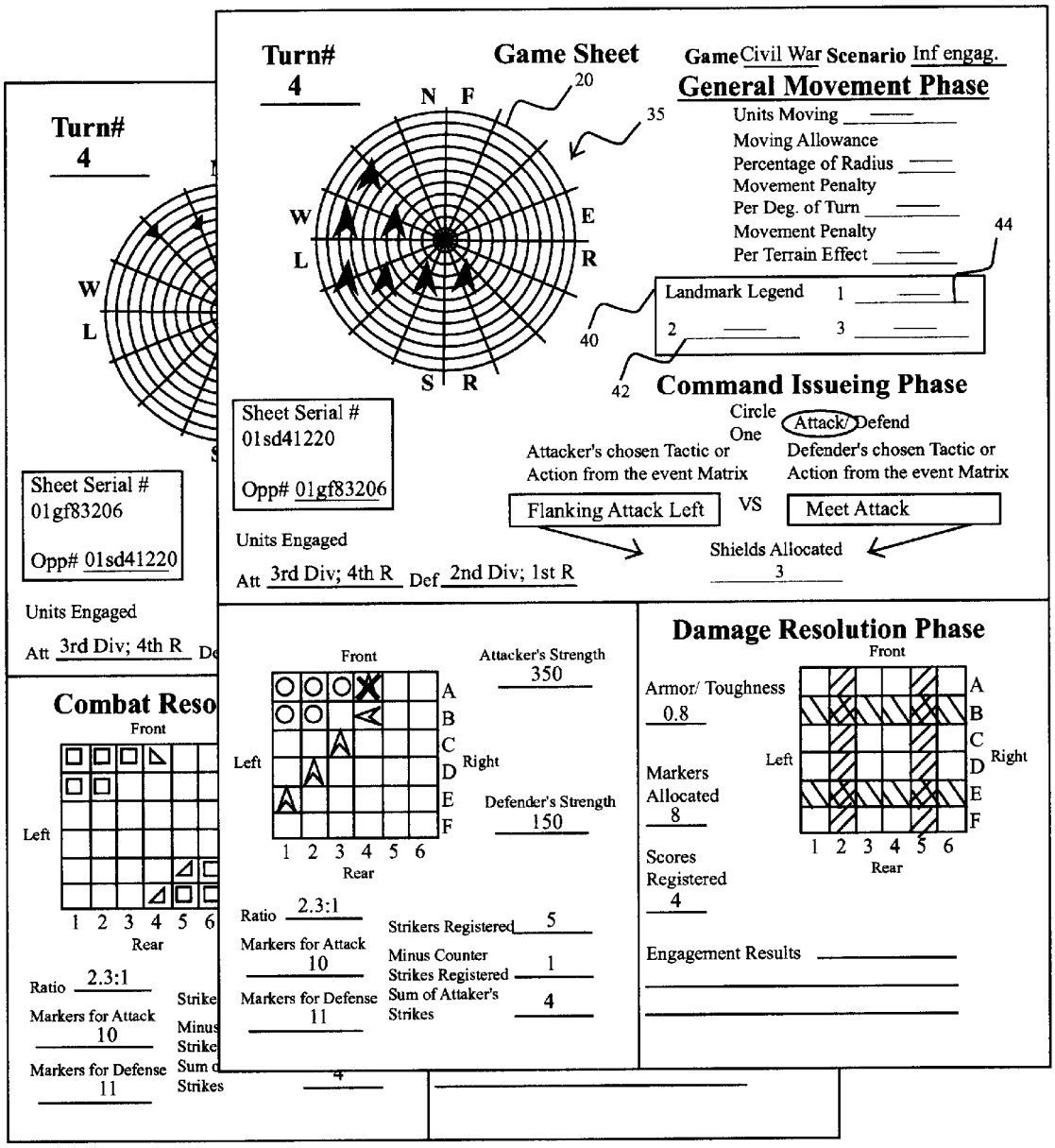
FIG. 9 illustrates a pair of conflict resolution sheets that are semi-transparent, a first of the sheets being laid over a second of the sheets to permit marked and unmarked areas of the superimposed sheets to be readily ascertained.

In another aspect of the invention, shown in FIG. 9, disposable sheets of paper, vellum or plastic are used in place of a game board and detachable markers. Preferably, a plurality of conflict resolution game sheets 50 are adapted to be torn away from a sheet tablet (not shown). Use of a tablet is advantageous because it permits easy storage and organization for the sheets 50, and creates a rigid surface on which to write. With use of disposable conflict resolution sheets 50, the actions performed by each player occur substantially simultaneously, as the players draw the indicia on their sheets. These substantially simultaneous actions are affected without random number generation.

Conflict resolution is further facilitated through use of conflict resolution sheets 50 that are semi or fully transparent. The transparent characteristic of the sheets permits a first player's game sheet 52 to be laid over a second player's sheet 54, so that the marked and unmarked areas of the superimposed conflict resolution sheets are readily ascertained. When a player holds a plurality of conflict resolution sheets 50 in an overlaid, superimposed position, the intersections of the conflict and resolution phases are readily apparent. Additional symbols or annotations are drawn on the top sheet, causing the final results of the conflict resolution process to be tallied quickly in a highly accurate manner. The procedure is thereafter completed by redistributing the annotated sheet to the second player for confirmation of results noted by the player, and annotation of the second player's sheet Tracking of information recorded on the conflict resolution sheets is aided by providing each sheet with certain identifiers, such as a unique, sequential, serial number. Use of an unique, sequential, serial numbers facilitates identification of the sheets and makes them easy to trace. A blank space located beneath the serial number is used to record the serial number of the opponent's conflict resolution sheet. Means for recording the turn for which a game sheet is being used further assists with identification and tracing of the sheets. These features are especially useful when distinguishing sheets of one player from another during tournament play involving numerous participants. The record provided by the sheet identifiers discussed hereinabove can be used by tournament judges during evaluation of player performance.

In still another aspect of the invention, the conflict resolution sheet and the procedures for creating markings and images thereon can be generated and implemented by an electronic device. Typically, the device comprises: an LCD or other light emitting display; (ii) an alphanumeric key pad; (iii) game indicia manipulation means for generating and moving images representing the indicia on graphics contained by the device: (iv) transmitting means for transmissions effected by radio, microwaves or through a wire connection; (v) RAM memory means for storing game rules and procedures; and (vi) software means, for down loading game rules into the RAM memory using a memory card or direct computer connection. One device that is representative has been produced and sold by the Cybico Company as a wireless entrainment system. This device is capable of creating electronic images depicting game indicia on the an LCD screen and sending text messages. It also comprises means for establishing a connection with a computer. By connecting a plurality of these devices together using the same peripheral, combat resolution in hobby war games can be achieved in an accurate, reliable and efficient manner. Devices used in implementing the war and role game playing features of the invention are preferably associated with a computer, which performs all matching and storing functions for pertinent information required during game play. Graphics used during each stage of the conflict resolution appear on the LCD screen, and the players utilize appropriate keys to create the images otherwise produced by marking transparent or semi transparent game sheets.

Having thus described the invention in rather full detail, it will be understood that such detail need not be strictly adhered to but that various changes and modifications may suggest themselves to one skilled in the art, all falling within the scope of the present invention as defined by subjoined claims.

What is claimed is:

1. A conflict resolution system for strategy games involving a defender and an attacker, comprising:

a. a plurality of game sheets;

b. at least a first and a second of said game sheets being adapted to be completed by a defender and an attacker, respectively, and having printed thereon a geometric array and text indicating deployment of game pieces by said defender and attacker in accordance with a defined set of rules;

c. each of said game sheets comprising material having transparency sufficient for viewing of marks contained by at least two sheets in an overlaid condition;

whereby marks on said sheets are viewed substantially simultaneously when said first and second sheets are overlaid, and determination of intersecting game pieces required for conflict resolution is facilitated.

2. A conflict resolution system as recited by claim 1, wherein each of said game sheets has printed thereon a unique serial number.

3. A conflict resolution system as recited by claim 2, wherein said serial numbers are sequentially assigned.

4. A conflict resolution system for strategy games, as recited by claim 1, wherein said completion of said first and second game sheets is accomplished substantially simultaneously, independent of random number generation.

5. A conflict resolution system, as recited by claim 4, wherein each of said first and second game sheets comprises:

a. a command issuing phase portion;

b. a combat resolution phase portion; and c. a damage resolution phase portion.

6. A method for resolving a conflict in a strategy game, comprising the steps of:

a. attacker secretly arranging markers on a first conflict resolution board;

b. defender secretly arranging markers on a second conflict resolution board; and c. identifying substantially simultaneously regions of conflict on said first and second conflict resolution boards, whereby said attacker attempts to anticipate regions where said defender will place markers and said defender attempts to avoid placing markers in regions where said attacker places markers and resolution of marker placement for all regions is accomplished substantially simultaneously.

7. In a hobby war game comprising a geometric array for defining the space around a game piece, character or unit in relation to said game piece, character or unit, and wherein information about the formation, attitude or motion of said game piece is provided by markers and graphic elements in accordance with a defined set of rules, the improvement comprising a conflict resolution system, comprising:

a. a plurality of game sheets;

b. at least a first and a second of said game sheets being adapted to be completed by a defender and an attacker, respectively, and having printed thereon a geometric array and text indicating deployment of game pieces by said defender and attacker in accordance with a defined set of rules;

whereby marks on said sheets are viewed substantially simultaneously and determination of intersecting game pieces required for conflict resolution is facilitated.

8. A method for resolving a conflict in a strategy game, comprising the steps of:

a. attacker secretly arranging markers on a first conflict resolution board;

b. defender secretly arranging markers on a second conflict resolution board; and c. substantially simultaneously identifying regions of conflict on said first and second conflict resolution boards, whereby said attacker attempts to anticipate regions where said defender will place markers and said defender attempts to avoid placing markers in regions where said attacker places markers, and the intersection of conflicting game pieces is determined substantially simultaneously, without random number generation.

9. An apparatus for resolving a conflict in a strategy game, comprising:

a. a plurality of conflict resolution boards, each of said boards comprising a geometric array; and b. a plurality of markers, each of which represents a military unit, said markers being provided with graphics indicating the formation, attitude or motion of said units in accordance with a defined set of rules;

c. means for identifying simultaneously regions of conflict on said conflict resolution boards;

whereby the outcome of said conflict is dependent on said formation, attitude, or motion, and resolution of conflict regions is accomplished simultaneously, and independent of random number generation.

* * * * *